US006286173B1

(12) United States Patent
Briones

(10) Patent No.: US 6,286,173 B1
(45) Date of Patent: Sep. 11, 2001

(54) 2-HEAD TOOTHBRUSH WITH SUREHOLD

(76) Inventor: Nick Walter Alcantara Briones, 701 SW. 7th St., Live Oak, FL (US) 32060-2237

( * ) Notice: Subject to any disclaimer, the term of this patent is extended or adjusted under 35 U.S.C. 154(b) by 0 days.

(21) Appl. No.: 09/409,346

(22) Filed: Sep. 30, 1999

(51) Int. Cl.[7] ..... A46B 5/02; A46B 9/04

(52) U.S. Cl. ..... 15/167.1; 15/143.1; 16/430; D4/105; D4/129; D8/107

(58) Field of Search ..... 15/143.1, 167.1, 15/167.2; D4/104–106, 129; 16/430; D7/394; D8/107, DIG. 4–DIG. 7; 30/232, 295; 81/489

(56) References Cited

U.S. PATENT DOCUMENTS

D. 324,455 * 3/1992 Fasitta et al. ..... D4/104
2,603,865 * 7/1952 Sneed ..... 30/232

FOREIGN PATENT DOCUMENTS

340976 * 9/1920 (DE) ..... 30/295
642976 * 9/1928 (FR) ..... 15/167.1
2548528 * 1/1985 (FR) ..... 15/167.1
127777 * 6/1919 (GB) ..... 30/295
5-168526 * 7/1993 (JP) ..... 15/167.1

* cited by examiner

*Primary Examiner*—Mark Spisich

(57) ABSTRACT

A toothbrush comprising dual brush heads (6), (8) spaced by gap (12) each having brushes (18), (20) on a surface, made of substantially parallel bristles so each total width of the brush heads (10), (14) and the gap, of the brushes (22), (24) and the gap, and of a lower row and upper row of human teeth are approximately equal, giving the brushes (16) optimized coverage in horizontal stroke; an elongated neck (34) having a first end extending from an end of the brush heads (4) and a second end; and an elongated handle (26) having a proximal end extending from the second end of the neck and an opposite distal end, and having three openings (28), (30), (32) of different size inside three annular rings arranged in order of decreasing size from the proximal to the distal end so the rings and the openings are substantially symmetrical with respect to an axis passing from the second end of the neck through center portions of the rings wherein a light grip by inserted fingers always produces a perfect hold.

10 Claims, 1 Drawing Sheet

2-HEAD TOOTHBRUSH WITH SUREHOLD

BACKGROUND

1. Field of Invention

My invention relates to improvements in toothbrushes of a type of toothbrush having one head that is commonly and presently in use by humanity.

2. Description of Prior Art

Grocery stores, pharmaceutical stores and supermarkets display for sale the type of toothbrush having only one head, and having a nonslip handle for the expensive toothbrushes. The brushes and the head is about the same in width. The width of the brushes or the head can cover at least one row of teeth in a single horizontal stroke. To cover both the upper row and lower row of the teeth requires two horizontal strokes. Thus there is a need for a toothbrush with sufficient quantity of brushes to cover simultaneously both the upper and lower rows of the teeth in a single stroke. The numerous strokes required by the one head toothbrush to clean all the teeth in a mouth also produce numerous chances to injure the gums and other parts inside the mouth.

Besides the numerous strokes required by the one head toothbrush to clean all the teeth, a major cause of injury inside the mouth is an inefficient clumsy hold of the handle. Even the expensive nonslip handle still needs a strong firm grasp by all fingers and thumb to effectively hold. Thus all the fingers and the thumb are fully occupied with holding the handle for fear of loose holds or of dropping the toothbrush, instead of focusing only to precisely controlling and safely guiding the brushes to clean the teeth inside the mouth. The inefficient and clumsy hold by all the fingers and the thumb to the handle results to wild uncontrolled assaults to the gums, the teeth and other parts inside the mouth. Thus there is a need for a toothbrush handle that gives a perfect hold anytime, to a light grasp by only three fingers while letting the thumb and forefinger free to precisely control and safely guide the brushes in cleaning the teeth inside the mouth.

In addition to the one head toothbrush with the nonslip handle, many inventors created several types of toothbrushes, all of which have one thing in common; they are all very costly to manufacture. The production costs are the cost of many different materials and labor to make many different parts, in many processes and procedures ending in assembly work and finally to jacked up sale prices beyond reach of most consumers. And most if not all of these articles fail to clean the teeth after repeated use specially under wet or slippery conditions. U.S. Pat. No. 4,048,690 Wolfson (1977) is a rotary toothbrush with twin heads; U.S. Pat. No 05,499,421 Brice (1996) is another toothbrush with angled and movable twin heads; U.S. Pat. No. 5,517,713 Hadcock (1996) is a toothbrush with a sure-grip handle that can not give the perfect hold by the light grasp of only three fingers that my 2-head toothbrush with surehold handle can give.

The following description and accompanying illustrations apply to my improvements upon the one head toothbrush with nonslip handle, with which my 2-head toothbrush with surehold handle is similarly made of rigid thermoplastic and synthetic brushes without the nonslip unnecessary material, but radically differ in everything else. All the toothbrushes heretofore known suffer from a number of disadvantages:

(a) Their sale prices are too expensive and not affordable by end users.

(b) Their manufacturing costs are uneconomically sound due to high costs of labor and materials in making and assembling many different parts that used many different processes and procedures.

(c) They are not easy to produce.

(d) They require too many strokes to cover and clean all the teeth thus they produce too many chances of injuring the gums and other parts inside the mouth.

(e) They take a lot of time and effort to use due to one stroke can only cover one row of teeth.

(f) They are difficult to use requiring the clumsy hold by all the fingers and the thumb in order to hold, resulting to wild uncontrolled assault to the gums and to the other parts inside the mouth.

(g) They have insufficient quantity of brushes to last longer after a repeated use without permanently bent brushes.

(h) They can not maintain a strong clean teeth for a long time without injuries inside the mouth due to too many strokes, insufficient brushes to do the cleaning of the teeth, poor control and guidance of the brushes and the head inside the mouth due to the inefficient clumsy hold by all the fingers and the thumb.

(i) They do not satisfy the need for an inexpensive, safe, fast, easy to use in wet or slippery conditions, reliable, durable, high quality, highly efficient toothbrush.

OBJECTS AND ADVANTAGES

Accordingly, several objects and advantages of my 2-head toothbrush with surehold handle are:

(a) to provide an inexpensive toothbrush affordable by most humanity.

(b) to provide minimized manufacturing expenses in producing a high quality toothbrush of only one piece thermoplastic formable plastic and synthetic brushes with no detachable and moving parts to eliminate expenses on other materials, labor, and processes.

(c) to provide an easy to produce toothbrush without costly processes, nonslip coating materials, parts to make with different materials, and without any assembly works.

(d) to provide a toothbrush requiring less strokes to clean the teeth resulting to less chances of injuring the gums and other parts inside the mouth.

(e) to provide a toothbrush with sufficient quantity of brushes to cover in a single stroke both at the same time, the upper and lower rows of the teeth, thus clean all the teeth at less time and effort.

(f) to provide a toothbrush that is easy to use by having a handle with a perfect hold by only three fingers thus letting the thumb and the forefinger to precisely control and safely guide the brushes in cleaning all the teeth in the mouth, faster and with less strokes.

(g) to provide a toothbrush with sufficient quantity of brushes having optimized coverage in width, to clean the teeth without permanently bent brushes after repeated use.

(h) to provide a toothbrush that can maintain a strong clean teeth for years without injuries inside the mouth due to too many strokes and with sufficient quantity of brushes to clean the teeth with less strokes; and with the precise control and safe guidance of the brushes in the mouth, by the thumb and forefinger while the other three fingers hold perfectly the toothbrush handle with a light grip.

(i) to provide a toothbrush that satisfies the need for an inexpensive, safe, fast, easy to use in wet or slippery conditions, reliable, durable, high quality, and high efficiency toothbrush.

Further objects and advantages are to provide a toothbrush that is easy and convenient for use by lefthanded or righthanded users due to the three holes that can be entered at both ends for the perfect hold of the handle; the handle that gives the perfect hold by the light grip even by athritic fingers; with a one-piece construction or molding with no attachments or movable parts. Still further objects and advantages will become apparent from a consideration of the ensuing description and drawings.

DRAWING FIGURES

REFERENCE NUMERALS IN DRAWINGS

| | |
|---|---|
| 4 heads | 6 left head |
| 8 right head | 10 width of left head |
| 12 width of empty space | 14 width of right head |
| 16 brushes | 18 right brushes |
| 20 left brushes | 22 width of right brushes |
| 24 width of left brushes | 26 handle |
| 28 hole for littlefinger | 30 hole for ringfinger |
| 32 hole for middlefinger | 34 neck |

Figure 1:
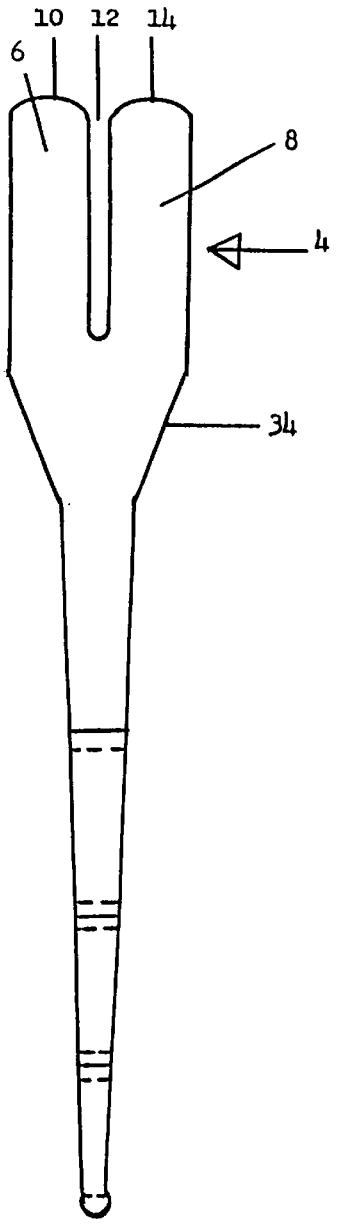
FIG. 1 shows a rear view of the 2-head toothbrush with surehold.
Figure 2:
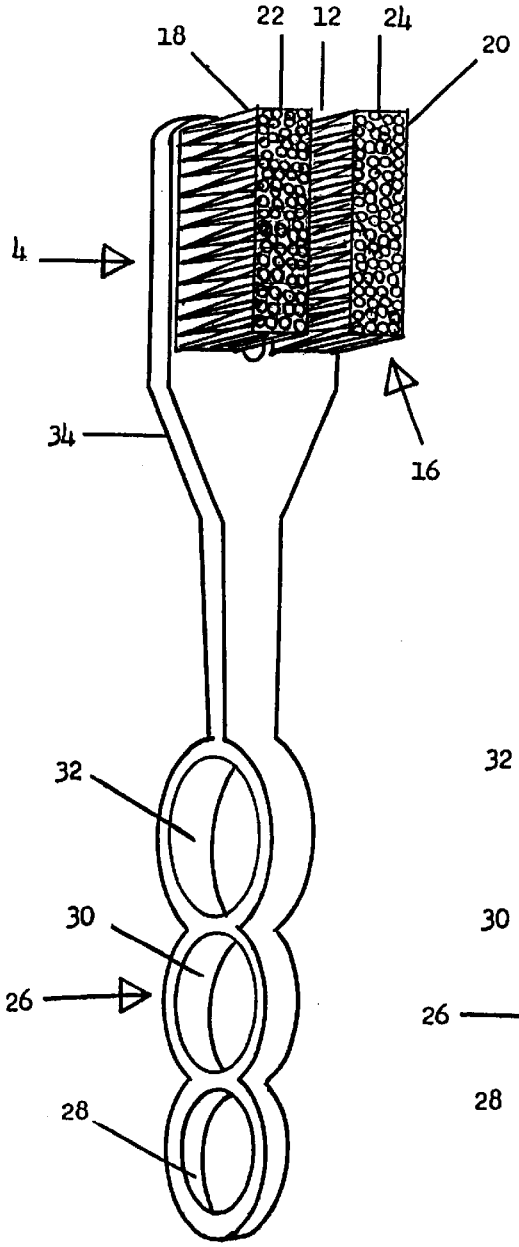
FIG. 2 shows an elevation front view of the FIG. 1. article.
Figure 3:
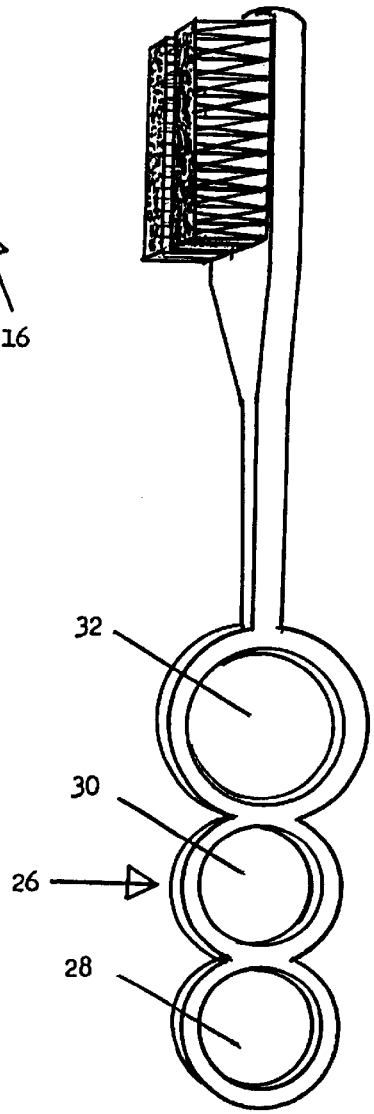
FIG. 3 shows a perspective view of the FIG. 1 article.

Description—FIGS. 1, 2, 3

A typical embodiment of the 2-head toothbrush with surehold is illustrated in FIG. 1 that shows a rear view of the two heads 4, the neck 34, and the handle 26 all of which is a rigid one-piece mold made of thermoplastic with no moving parts or attachments. The heads 4 has a left head 6 of width 10, and a right head 8 of width 14. Width of empty space between the heads 4 is 12. The neck 34 holds the heads 4, and tapers in width to the handle 26 which in turn tapers to the end in order to save in materials.

Going to FIG. 2 that shows the elevation view of the brushes 16 and the handle 26, we see that the brushes 16 have left brushes 20 of width 24 and right brushes 18 of width 22, with both brushes implanted firmly into their corresponding heads 4 (FIG. 1). The brushes 16 are made of synthetic materials.

Now, the combined widths: 22 of the right brushes 18, 24 of the left brushes 20, and 12 of the empty space are approximately the same as the combined widths: 14 of the right head, 10 of the left head, and 12 of the empty space and, furthermore are approximately the same as the combined widths of an upper row and lower row of teeth, measured from an upper gum to a lower gum with the upper and lower rows of the teeth, pressed lightly together inside a mouth. In this manner is the minimum width of the brushes 16 or the heads 4 determined, in order that a single horizontal stroke by the brushes 16 can cover, simultaneously both the upper and the lower rows of the teeth, thus reducing the number of strokes to clean all the teeth, and consequently less time and effort, and less chances of injury inside the mouth. And the large quantity of the brushes 16 to do the job makes them last longer after repeated use, without permanently bent brushes.

Now let us go to FIG. 3 and see the novel handle 26 comprising of three holes of different diameters or sizes: a small hole 28 for a littlefinger, a, big hole 30 for a ringfinger, and a bigger hole 32 for a middlefinger. After inserting the three fingers into the holes, a light grip is all it takes to produce a perfect hold of the handle 26, thus letting free both the thumb and the forefinger to focus fully to the job of a precise control and safe guidance of the brushes 16 (FIG. 2) inside the mouth.

Finally, all corners and edges of the heads 4, the neck 34, and the handle 26 are typically rounded or beveled to avoid personal injury.

From the descriptions above, a number of advantages of the 2-head toothbrush with surehold handle become evident:

(a) The one-piece 2-head toothbrush with surehold handle is inexpensive and affordable by most humanity.

(b) Production expenses are minimized by eliminating the costs of many different materials such as the nonslip material for the handle, many processes such as the coating process for the nonslip handle, the costs of making many parts then assembling the parts.

(c) Producing the one-piece 2-head toothbrush with surehold is easy requiring only a onetime modifying of the mold used presently in making the one head toothbrush; the same thermoplastic and synthetic brushes are still used, without all the other materials, labor, and processes for making and assembling parts.

(d) Less strokes to clean all the teeth are needed by the sufficient quantity of brushes whose widths are optimized to cover both the upper and the lower rows of the teeth simultaneously in one stroke, thus less chances of injury to the gums and other parts inside the mouth, result.

(e) Less time and effort are needed to thoroughly clean all the teeth due to the sufficient quantity of the brushes whose widths are optimized to a wider coverage of the teeth in a single stroke such as covering both the rows of the teeth simultaneously.

(f) The 2-head toothbrush with surehold is very easy to use by all types of humanity with teeth; simply insert the three fingers of a lefthand or a righthand into the holed handle, lightly grip the handle to produce the perfect hold under wet or slippery conditions, then let the free thumb and forefinger focus completely to the precise control and safe guidance of the brushes with the optimized coverage to clean all the teeth at less strokes and less time.

(g) The sufficient quantity of the brushes whose optimized coverage cleans the teeth with less strokes, last longer without loss of efficiency to clean the teeth, after repeated use.

(h) The sufficient quantity of the brushes with the optimized width to clean all the teeth at less strokes coupled to the precise control and the safe guidance of the brushes inside the mouth by the freely focused thumb and forefinger while the remaining fingers lightly grip the handle for the perfect hold, maintain strong clean teeth for years without injuries inside the mouth.

(i) The 2-head toothbrush with surehold satisfies the unfilled need for the inexpensive, safe, fast, easy to use by the left or right handed humanity under wet or slippery conditions, reliable, durable, high quality, and highly efficient toothbrush.

Operation—FIGS. 1, 2, 3

The manner of operating the 2-head toothbrush with surehold is easy and convenient for lefthanded or righthanded humanity with teeth. Simply insert the littlefinger into the hole 28, the ringfinger into the hole 30, and the middlefinger into the hole 32 then grip lightly to have the perfect hold. Then let the free thumb and forefingers focus completely on the precise guidance and control of the brushes 16 inside the mouth to safely clean all the teeth, without fear of dropping the toothbrush due to loose hold of the handle 26 (FIGS. 2 and 3). The holes can be entered through both ends.

After the assurance of the perfect hold, concentrate on the thorough cleaning of all the teeth. The combined widths: 22 of the right brushes 18, 24 of the left brushes 20, and 12 of the empty space in FIG. 2 are about the same as the combined widths: 14 of the right head 8, 10 of the left head 6, 12 of the empty space in FIG. 1, and furthermore are about the same as the combined widths of the upper and the lower rows of the teeth measured from the guns, with the upper and lower rows of the teeth pressed lightly together. Tins one stroke of the brushes 16 in FIG. 2 covers simultaneously both rows of the teeth. This optimized width and coverage of the brushes 16 results to a minimized number of strokes to clean all the teeth, at less time and effort. And finally ending to the safe cleaning of the teeth without injury to the gums and other inner parts of the mouth, with sufficient quantity of the brushes 16 lasting longer, after repeated use.

Summary, Ramifications, and Scope

Accordingly, the reader will see that my invention of the 2-head toothbrush with the surehold handle satisfies the unfulfilled need for inexpensive, safe, fast, easy to use under wet or slippery conditions, reliable, durable, high quality, and highly efficient toothbrush. Cleaning all the teeth is safe and fast with substantially reduced number of strokes due to the optimized width and coverage of the sufficient quantity of brushes 16 or heads 4 whose widths can cover simultaneously in a single stroke, both the upper and lower rows of the teeth. The combined widths, 22 of the right brushes 18 in FIG. 2, 24 of the left brushes 20, and 12 of the empty space are about the same as the combined widths, 14 of the right head 8 in FIG. 1, 10 of the left head 6, and 12 of the empty space, and furthermore are about the same as the combined widths of the upper and lower rows of the teeth measured from the gums with the upper and lower rows of teeth pressed lightly together. The surehold handle 26 in FIG. 3 contributes substantially to the efficient use of the 2-head toothbrush.

After inserting the littlefinger into the hole 28, the ringfinger into the hole 30, and the middlefinger into the hole 32, a light grip produces the perfect hold of the handle 26 thus the free thumb and forefinger focus fully to the precise control and guidance of the brushes 16 (FIG. 2) to safely clean all the teeth in the mouth.

Other advantages of the 2-head toothbrush with surehold handle are:

(a) inexpensive and affordable by most humanity.

(b) minimized production expenses by eliminating expenses on many different materials except the thermoplastic and the synthetic brushes, on additional processes such as coating the handle with the nonslip material, on making and assembling many parts by reducing the article to only a one-piece molded article.

(c) easy to produce requiring only a onetime modifying of the presently in use mold to make the one head toothbrush to conform to the 2-head toothbrush with surehold handle; the same thermoplastic and synthetic brushes are still used and no other materials, labor, processes are needed to make or assemble parts.

(d) safe to use due to the substantially reduced number of strokes needed to clean all the teeth by the sufficient quantity of brushes with optimized coverage, and the perfect hold given by the handle to a light grip of only three fingers while the thumb and forefinger efficiently manage the cleaning of the teeth by the brushes inside the mouth.

(e) less time and effort needed to clean all the teeth by the sufficient quantity of brushes with the optimized width and coverage that can simultaneously cover in a single stroke both the upper and lower rows of the teeth in the mouth.

(f) easy and convenient to use by lefthanded or right-handed humanity even with slightly athritic fingers under wet or slippery conditions: simply insert the three fingers into the holed handle, lightly grip to have a perfect hold, then let the free thumb and forefinger efficiently manage the brushes to thoroughly clean all the teeth inside the mouth at substantially reduced strokes due to the optimized coverage of the brushes.

(g) has longlasting brushes after repeated use due to the sufficient quantity and the optimized widths of the brushes that clean all the teeth with substantially reduced strokes.

(h) can maintain the strong clean teeth for years without injuring the innerparts of the mouth due to the substantially reduced strokes needed by the sufficient quantity of the brushes with optimized coverage to clean all the teeth and also due to the efficient management of the brushes inside the mouth, by the thumb and forefinger while the remaining three fingers have the perfect hold on the handle.

(i) satisfies the unfulfilled need for the inexpensive, safe, fast, easy to use under wet or slippery conditions, reliable, durable, high quality and highly efficient toothbrush.

Although the descriptions above contain many specificities, these should not be construed as limitations on the scope of the invention but rather as exemplification of one preferred embodiment thereof. Many other varieties are possible. For example, the neck 34 (FIG. 1) can be bent. There are also many applications of the surehold handle that gives a perfect hold by the grip of only three fingers with the thumb and the forefinger free to perform more exacting work other than holding the handle, such as in emergency medical tools for use in slippery, wet conditions to save a life; or in other very expensive nonreplaceable tools where dropping the tool could cause costly delays in finishing a project.

Accordingly, the scope of my inventions should be determined not by the embodiments illustrated but by the claims and their legal equivalents.

What is claimed is:

1. A toothbrush comprising a) a brush portion comprising first and second elongated brush heads each having bristles extending from a surface thereof with the bristles being substantially parallel to each other, the brush heads be spaced from each other so as to define an elongated gap therebetween;

b) an elongated neck portion having a first end extending from an end of the brush portion and an opposite second end;

c) an elongated handle portion having a proximal end extending from the second end of the neck portion and an opposite distal end, the handle portion including three openings therein which are arranged along the length of the handle portion, a first of the openings being adjacent the neck portion and having a first size for receiving the user's middle finger, a second of the openings being located adjacent the first opening and having a second size smaller than that of the first opening for receiving the user's ring finger and a third of the openings having a third size smaller than that of the second opening for receiving the user's little finger; and d) the three openings of the handle portion being defined by a series of three annular rings of different size with the rings arranged in order of decreasing size from the proximal to the distal end of the handle portion, the second end of the neck portion defining an axis passing through center portions of the rings whereby the rings and the openings defined thereby are substantially symmetrical with respect to said axis.

2. The toothbrush of claim 1 wherein said elongated brush heads and gap define a total width which about equals that of lower row and upper row of human teeth with the rows pressed lightly together whereby the brush heads and therefore the bristles gain optimized coverage of both rows simultaneously in horizontal stroke, and take less strokes to clean all the teeth.

3. The toothbrush of claim 2 wherein said bristles are made of synthetic materials.

4. The toothbrush of claim 3 wherein said bristles are quantitatively durable whereby substantial quantity of the bristles to clean teeth produces less permanent bending of the bristles after repeated use.

5. The toothbrush of claim 1 wherein said three openings and said three annular rings always produce a perfect hold by a light grip of inserted fingers even in wet slippery conditions whereby the unoccupied fingers can focus in managing more efficient cleaning of all teeth.

6. The toothbrush of claim 1 wherein said handle portion, said neck portion, and said first and second brush heads are molded as one piece.

7. The toothbrush of claim 6 wherein said one piece of mold has corners and edges rounded or beveled.

8. The toothbrush of claim 7 wherein said one piece of mold is made of thermoplastic material.

9. An implement handle comprising:

a) an elongated neck portion having a first end adjacent a working end of the implement and an opposite second end;

b) an elongated handle portion having a proximal end extending from the second end of the neck portion and an opposite distal end, the handle portion including three openings therein which are arranged along the length of the handle portion, a first of the openings being adjacent the neck portion and having a first size for receiving the user's middle finger, a second of the openings being located adjacent the first opening and having a second size smaller than that of the first opening for receiving the user's ring finger and a third of the openings having a third size smaller than that of the second opening for receiving the user's little finger, and c) the three openings of the handle portion being defined by a series of three annular rings of different size with the rings being arranged in order of decreasing size from the proximal to the distal end of the handle portion, the second end of the neck portion defining an axis passing through center portions of the rings whereby the rings and the openings defined thereby are substantially symmetrical with respect to said axis.

10. The implement handle of claim 9 wherein said elongated handle portion with said three openings in said three annular rings, sufficiently produces perfect hold by a light grip of inserted fingers leaving two unoccupied fingers to manage efficiently a task other than holding.

* * * * *